US005584716A

United States Patent [19]

Bergman

[11] Patent Number: 5,584,716

[45] Date of Patent: Dec. 17, 1996

[54] TERMINAL ASSEMBLY FOR HERMETIC COMPRESSOR

[75] Inventor: Ernest Bergman, Rossburg, Ohio

[73] Assignee: Copeland Corporation, Sidney, Ohio

[21] Appl. No.: 274,980

[22] Filed: Jul. 14, 1994

[51] Int. Cl.[6] ..... H01R 13/74

[52] U.S. Cl. ..... 439/282; 174/152 GM; 439/278; 439/680; 439/911; 439/935

[58] Field of Search ..... 439/278, 281, 439/282, 680, 685, 566, 926, 935, 350, 353, 357, 911; 174/152 GM

[56] References Cited

U.S. PATENT DOCUMENTS

| | | | |
|---|---|---|---|
| 1,941,905 | 1/1934 | Mair | 439/97 |
| 2,067,796 | 1/1937 | Smith | 439/108 |
| 2,728,060 | 12/1955 | Doeg | 439/685 |
| 3,016,511 | 1/1962 | Unger | 439/566 |
| 3,336,567 | 8/1967 | Coldren | 439/685 |
| 3,764,960 | 10/1973 | Heimbrock | 439/685 |
| 3,842,396 | 10/1974 | Olsson | 439/685 |
| 3,850,496 | 11/1974 | Hague | 439/685 |
| 3,917,377 | 11/1975 | Hall et al. | 439/685 |
| 4,584,433 | 4/1986 | Bowsky et al. | 174/152 GM |
| 4,740,177 | 4/1988 | Heimbrock | 439/596 |
| 4,786,762 | 11/1988 | Bowsky et al. | 174/152 GM |
| 5,017,740 | 5/1991 | Honkomp et al. | 174/152 GM |
| 5,035,653 | 7/1991 | Honkomp et al. | 439/685 |
| 5,129,843 | 7/1992 | Bowsky et al. | 439/685 |
| 5,131,858 | 7/1992 | Heimbrock | 439/685 |
| 5,145,417 | 9/1992 | Honkomp et al. | 439/685 |
| 5,199,898 | 4/1993 | Wisner | 439/685 |
| 5,336,105 | 8/1994 | Wisner | 439/367 |

*Primary Examiner*—Neil Abrams
*Attorney, Agent, or Firm*—Harness, Dickey & Pierce P.L.C.

[57] ABSTRACT

A hermetic terminal assembly has a plurality of conductor pins which define integral fusible links (36). A unique plug is provided which both separates the individual wires (70) leading to the conductor pins and allows, in cooperation with a fence or with the shell (21) of the compressor (10), for the restriction of access to the conductor pins while the conductor pins are connected to a power source. This unique plug also allows for the positioning of the integral fusible link on the outside of the shell (12) thus resolving the problems associated with compromising the integrity of the shell (12) upon separating of the fuse-like link (36). In addition, the plug insures that the conductor pins are maintained in an electrical isolated fashion should the fuse-like link (36) separate. The fence can be formed as a separate member or alternately to be integral with the terminal body. The plug can be formed with a lip (82) to sealingly engage the fence, or, when no fence is present, to directly engage the shell (12) (FIG. 9). Alternately, the plug can be formed with resilient portions for latching and scrolling engagement with the fence (FIGS. 11–13, 15, 16). The fence is also formable with a grounding lug and with an opening to ensure proper orientation of the plug. The plug can also be formed to cover the wire connection to the grounding lug.

36 Claims, 3 Drawing Sheets

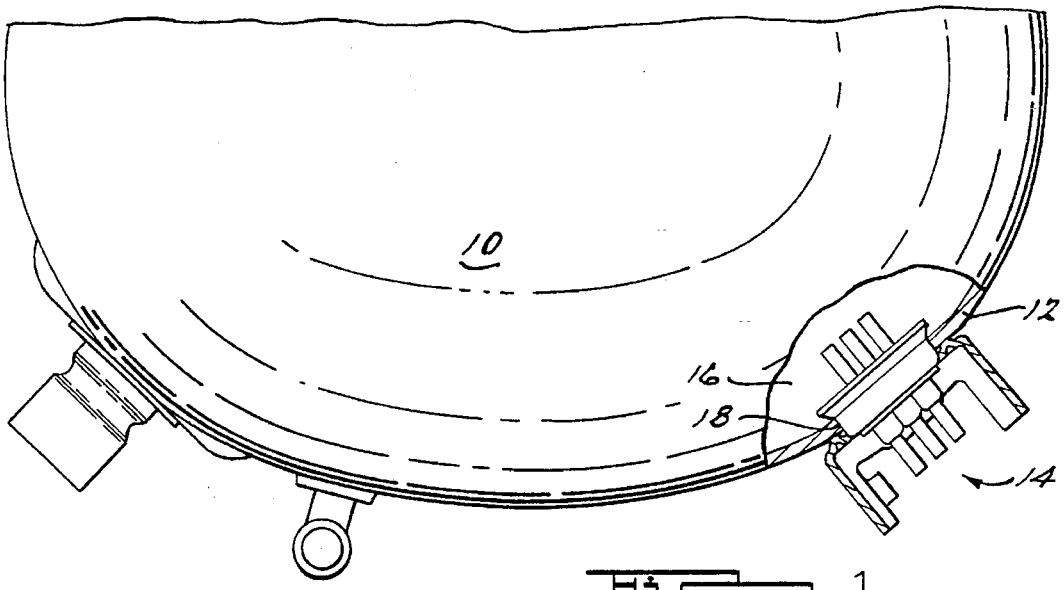
Fig. 1.
Fig. 2.
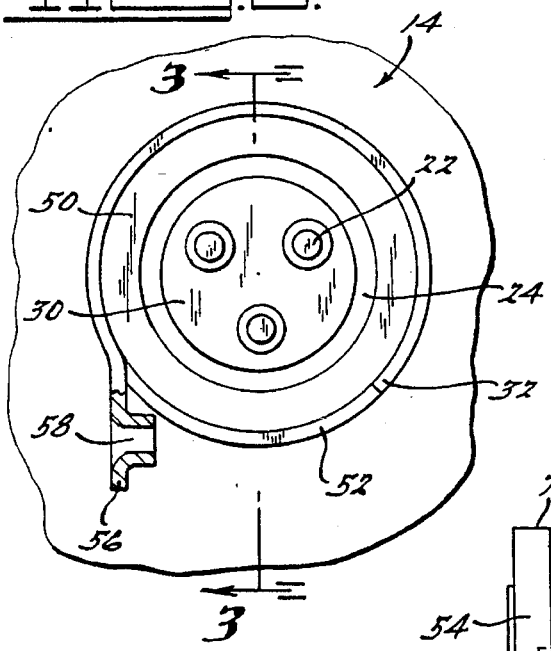
Fig. 3.
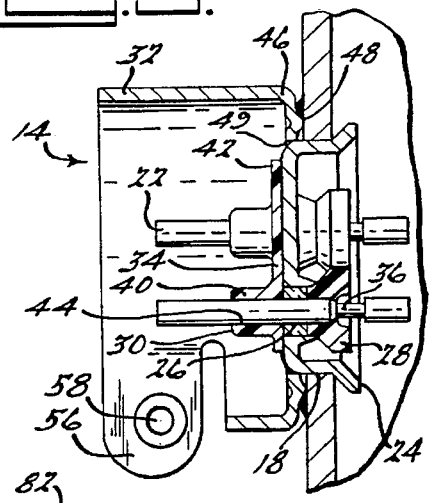
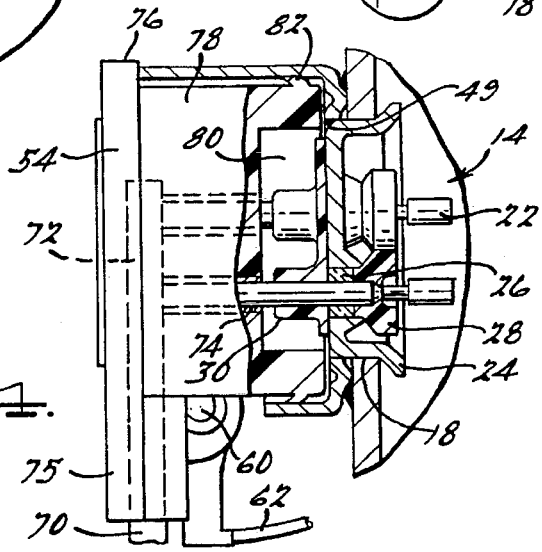
Fig. 4.

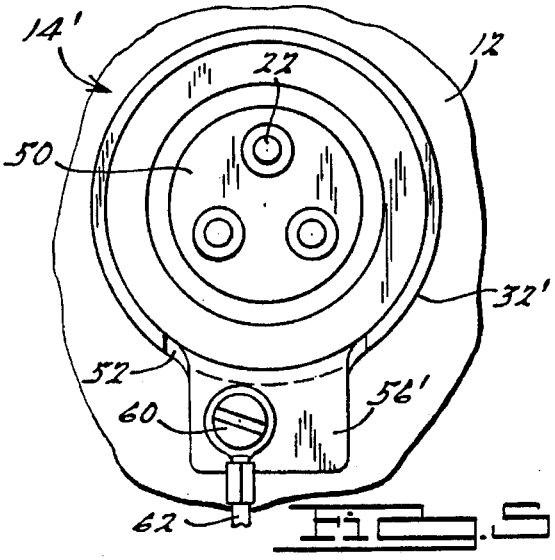
FIG. 5.
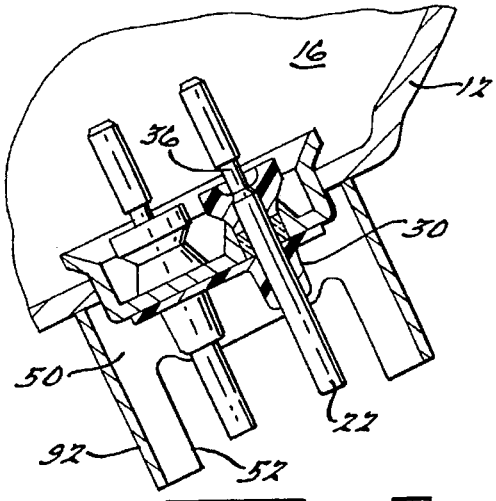
FIG. 6.
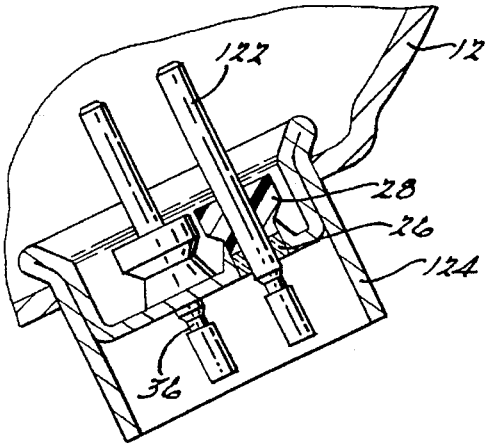
FIG. 7.
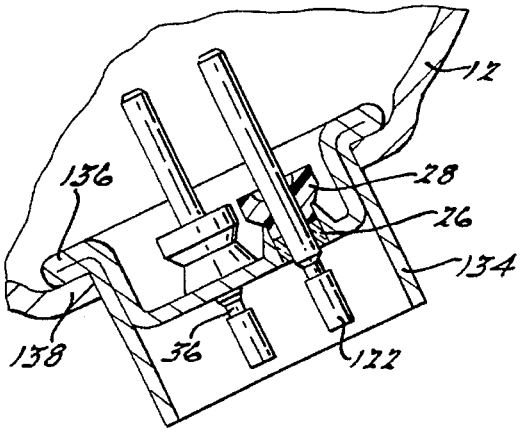
FIG. 8.
FIG. 9.
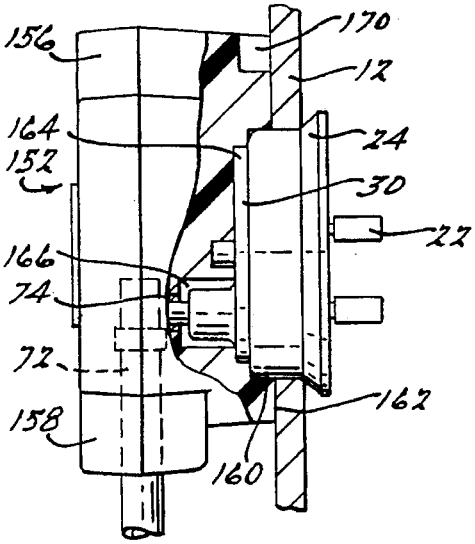
FIG. 10.
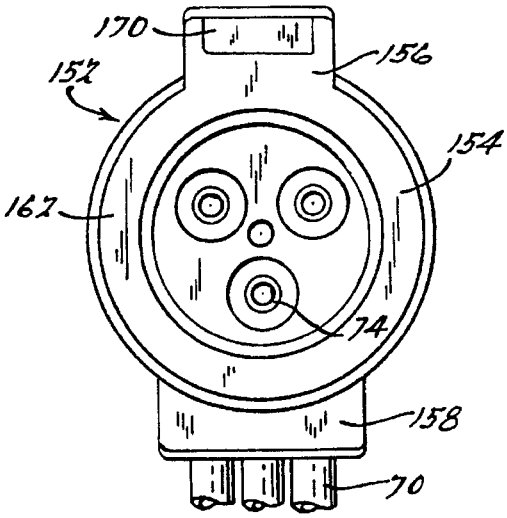

TERMINAL ASSEMBLY FOR HERMETIC COMPRESSOR

FIELD OF THE INVENTION

The present invention relates to an electric terminal for use with hermetic compressors. More particularly, the present invention relates to an electrical terminal which extends through the hermetic shell of the compressor and provides for a fused connection with the power plug as well as cooperating with the power plug to seal the connection from moisture and debris.

BACKGROUND OF THE INVENTION

Prior art terminal assemblies have included both terminal covers and/or fences which are designed to protect the terminals from physical damage as well as electrically isolating the terminals for safety concerns. While these prior art terminal assemblies have been effective, there is always a need to improve the safety of these terminal assemblies. The prior art terminal assemblies can permit an individual to operate the compressor without the installation of all of the various safety devices designed into the terminal assembly. Without these safety devises installed, the operation of the compressor can be achieved while having the individual terminals exposed creating a hazardous situation. The present invention eliminates this possibility by combining a unique terminal with a unique electrical plug.

Typically, a prior art hermetic terminal is installed in a hole formed in the hermetic shell of a hermetic compressor so that current may be carried to the motor of the compressor from an external source of power. The prior art terminals comprise a body welded or secured to the shell of the compressor and a plurality of conductor pins extending through the body. In order to seal and electrically insulate the conductor pins relative to the body, a glass-to-metal seal is employed, having an epoxy and/or silicone rubber overcoating. Both the inner and outer ends of the conductive pins may be provided with conductor tabs so as to facilitate connection to the external source of power on the outside of the shell and to the compressor motor on the inside of the shell.

One problem associated with these prior art terminals is that in response to unexpected abnormally high over current conditions e.g., due to ground fault or a short circuit, the conductor pins may heat up to the point of melting the conductor pins themselves or the surrounding glass-to-metal seals, thereby resulting in the failure or leaking of the hermetic terminal and thus the hermetic shell.

One method for preventing occurrence of the failure or leaking of the hermetic terminal is to use a fuse-like link within the conducive path of each conductor pin. Prior art hermetic terminals include pins which incorporate a reduced fuse-like area located on the segment of the pin which is positioned on the inside of the hermetic shell or on the segment of the conductor pin which is positioned on the outside of the hermetic shell. When an over current condition of the compressor occurs, this fuse-like area of the conductor pin separates. The fuse-like area of the conductor pin in prior art compressors is typically located on the inside of the shell for safety reasons. If the fuse-like area were located on the outside of the shell, the separating of the fuse-like area could free the power line which provides power to the conductor pin and allow this wire to short out against the shell and/or the other conductor pins or power lines. When the fuse-like area of the conductor pin is located on the inside of the shell, this separating of the fuse-like area of the conductor pin effectively disconnects power to the compressor but it also leaves the opportunity for the pin to be pushed out of the body of the terminal causing the leakage or failure of the hermetic terminal and thus the hermetic shell. Some prior art terminals have incorporated a stop flange integral with the fuse-like link in an attempt to insure that the pin will not be forced out of the body and cause blow out of the terminal. However, these types of terminals have a tendency to separate from the fused glass seal simultaneously with the separation of the conductor pin in an over current situation which then causes the leaking of the hermetic shell.

Another problem associated with the prior art terminals is that of corrosion. The conductor pins are normally constructed from stainless steel due to its corrosion resistance. Since one end of the conductor pins will be extending outside of the hermetic shell, corrosion of the exposed ends becomes a possibility if the conductor pins are not constructed of a corrosion resistant material. In addition, it is the usual practice to weld tabs or spades to the exposed outer ends of the conductor pins, which tabs or spades are adapted to receive terminal clips carried by the wiring which extends from the source of electrical power. This mechanical interconnection which exists between the terminal clips and the conductor pin tabs or spades is an additional area which is susceptible to corrosion and therefore requires some form of sealant.

Accordingly, there is a need for providing a conductor pin having an integral fuse-like link which maintains the integrity of the hermetic shell upon failure of the fuse-like link. Preferably, the fuse-like link would also be located on the outside of the shell with provisions being made to insure that upon melting of the fuse-like link, the power line leading to the fuse-like link is prevented from shorting out against any of the other compressor components. In addition, the outside connection of the conductor pins with the terminal connector should be provided with a sealing system which keeps both moisture and debris from degrading the mechanical connection between the conductor pin and the terminal connector.

SUMMARY OF THE INVENTION

The present invention provides the art with a unique hermetic terminal assembly which has a plurality of conductor pins having integral fuse-like links. The integral fuse-like link of the present invention is located on the outside of the hermetic shell thus insuring the integrity of the seal should the fuse-like link fail. The terminal assembly also includes unique plug which includes molded in receptacles for mating with both the conductor pins and the incoming power wires. The unique plug in combination with the externally located fuse-like links on the conductor pins maintains the seal of the hermetic shell upon melting of the fuse-like links. The safety of the terminal assembly is improved due to the fact that the live power lines are held in position by the plug after the separating of the fuse-like links. In addition, the plug eliminates the possibility of operating the compressor with exposed terminals to again improve the safety of the terminal assembly. The receptacles which are molded into the plug are positioned within the plug such that upon removal of the plug, the receptacles disengage from the conductor pins prior to the plug permitting access to the conductor pins from the outside. This additional safety feature insures that the plug must be installed to operate the compressor thus eliminating any access to the power lines while the compressor is connected to the power source. This terminal assembly of the present invention eliminates the industry requirement of having a terminal cover which requires a tool, or a clip which requires a tool, to remove the terminal cap. In addition to the safety features of the present invention, the connection between the conductor pins and the wires leading to the external power source are provided with a seal between the shell and the connector to eliminate moisture and debris from contaminating the connection between these components.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 1 is a partially cut away plan view of a hermetic shell of a hermetic compressor incorporating the terminal of the present invention;

FIG. 2 is a front view of the terminal of the present invention;

FIG. 3 is a cross-sectional side view of the terminal of the present invention taken in the direction of lines 3—3 in FIG. 2;

FIG. 4 is a cross-sectional side view similar to that shown in FIG. 3 but including the terminal plug in accordance with the present invention;

FIG. 5 is a view similar to FIG. 2 but showing an alternate location of the grounding lug and an alternate orientation of the connector pins;

FIG. 6 is a cross-sectional side view of a terminal in accordance with another embodiment of the present invention;

FIG. 7 is a cross-sectional side view of a terminal in accordance with another embodiment of the present invention;

FIG. 8 is a cross-sectional side view of a terminal in accordance with another embodiment of the present invention;

FIG. 9 is a side view, partially in cross-section of a plug and terminal according to another embodiment of the present invention;

FIG. 10 is a front view of the plug shown in FIG. 9;

DETAILED DESCRIPTION OF THE PREFERRED EMBODIMENT

Figure 11:
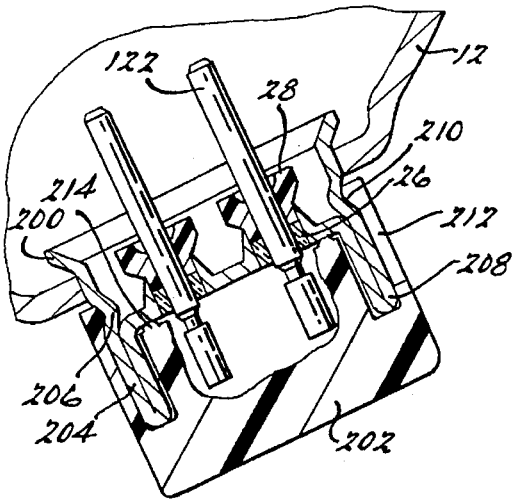
FIG. 11 is a cross-sectional side view of a terminal and plug in accordance with another embodiment of the present invention.

Referring now to the drawings in which like reference numerals designate like or corresponding parts throughout the several views, there is shown in FIG. 1, a hermetic compressor assembly which is designated generally by the reference numeral 10. Compressor assembly 10 can be a scroll compressor, a piston compressor or any other type of compressor. Compressor assembly 10 comprises a hermetic shell 12 having a terminal 14. Shell 12 defines a sealed chamber 16 within which a motor (not shown) and a compressor (not shown) are disposed. Terminal 14 is sealingly disposed within an aperture 18 which extends through shell 12. The sealing relationship between terminal 14 and shell 12 maintains the integrity of sealed chamber 16. Terminal 14 provides for the electrical connection between an external source of electrical power (not shown) and the motor disposed within chamber 16 as will be described later herein.

Referring now to FIGS. 2 through 4, terminal 14 is shown comprising a plurality of conductor pins 22, a terminal body 24, a plurality of fused glass insulators 26, a plurality of ceramic insulators 28, a silicone rubber molding 30 and a fence 32. Terminal body 24 is a cup shape metal member defining a plurality of holes 34. Terminal body 24 is sealingly disposed within aperture 18 by resistance welding or other methods known well in the art.

Each of the plurality of holes 34 is adapted for receiving a respective fused glass insulator 26 which is sealingly fused to both terminal body 24 and a respective conductor pin 22. Each conductor pin 22 extends through a respective fused glass insulator 26 to provide for the electrical communication between the exterior and interior of shell 12. Each conductor pin 22 includes a reduced diameter section 36 which acts as a fuse-like link in the event of an internal short circuit. FIGS. 2 through 4 show each of the reduced diameter sections 36 located within sealed chamber 16. It is within the scope of the present invention to locate reduced diameter sections 36 on the outside of shell 12 as illustrated in FIGS. 7 or 8.

Each conductor pin 22 has a respective ceramic insulator 28 secured to the end of pin 22 extending into chamber 16 defined by shell 12. Ceramic insulators 28 insulate conductor pins 22 and their associated connection to the motor within chamber 16 from contact with terminal body 24 as well as providing insulation between adjacent pins 22. Silicone rubber molding 30 is located on the outside of shell 12 and includes a plurality of upstanding jackets 40 which extent from base 42. The plurality of upstanding jackets 40 are equal to and are arranged in the same pattern as the plurality of conductor pins 22. Each of the jackets 40 defines an aperture 44 extending through molding 30 and adapted to receive a respective conductor pin 22. The relationship between apertures 44 and conductor pins 22 serves to both seal and provide an over surface insulation protection for conductor pins 22.

Fence 32 is fixedly secured to the outside of shell 12 by resistance welding or other means known well in the art. In the preferred embodiment, terminal body 24 and fence 32 are simultaneously resistance welded to shell 12 to provide the necessary hermetic seal. Fence 32 includes a formed flange 46 which has a welding bead 48 extending circumferentially around flange 46. Welding bead 48 enhances the resistance welding operation which secures and seals fence 32 to shell 12. Fence 32 forms an opening 49 which engages terminal body 24 to locate fence 32 on shell 12 as well as locating fence 32 with respect to conductor pins 22. This feature of locating fence 32 with respect to conductor pins 22 allows for a close fit between a mating plug 54 and terminal 14. Fence 32 defines a cavity 50 within which conductor pins 22 are located. The attachment between fence 32 and shell 12 provides a seal which prohibits moisture and/or debris from leaking into cavity 50 causing corrosion of conductor pins 22. Fence 32 also defines an opening 52 which is adapted for receiving the incoming wires of plug 54 as is shown in FIG. 4. The portion of the wall which is cut out of fence 32 to form opening 52 is bent out generally parallel to conductor pins 22 to an approximate verticle position as shown in FIGS. 2 and 3 to form a grounding lug 56. Grounding lug 56 defines an aperture 58 which is adapted to receive a self tapping screw 60 which holds a grounding wire 62 onto terminal body 24. Fence 32 not only provides for the sealing of the electrical connection for terminal 24, but it also protects conductor pins 22 from inadvertent damage due to the handling of compressor assembly 10 by the manufacturer of the compressor, the manufacturer of the apparatus utilizing compressor assembly 10 and any service personnel involved with servicing compressor assembly 10 or the apparatus utilizing compressor assembly 10.

Plug 54 is a molded plug which allows for the connection of the portion of conductor pins 22 located outside of shell 12 to a plurality of wires 70 which extend between plug 54 and the external supply of electrical power. Each wire 70 is electrically connected and secured to a connector 72 which provides a female electrical receptacle 74 for receiving a respective conductor pin 22. Connectors 72 and receptacles 74 are well known in the art and will not be discussed in any detail here. The plurality of wires 70 extend through a radially extending jacket 75 which provides for the access of the plurality of wires 70 into plug 54 in an orderly manner. Jacket 75 also cooperates with opening 52 to align receptacles 74 with conductor pins 22. The plurality of receptacles 74 are equal in number to and are arranged in the identical pattern to conductor pins 22 of terminal 14. The relationship between the pattern of conductor pins 22 and opening 52 is the same as the relationship between electrical receptacles 74 and jacket 75. Thus jacket 75 must be in line with opening 52 in order for electrical receptacles 74 to be in registry with conductor pins 22 and thus allow assembly of plug 54 onto terminal 14. The connection between conductor pins 22 and receptacles 74 provided for both an electrical connection between the two components as well as retention for keeping plug 54 in position on terminal 14. In addition, the location of receptacles within plug 54 insures that the separation between wires 70 will be maintained once one or all of reduced diameter sections 36 have separated.

Plug 54 comprises an end cap 76 and a connector body 78. Cap 76 seats against the outside edge of fence 32 when plug 54 is properly installed onto terminal 14. The seating of cap 76 against fence 32 aids in the sealing of cavity 50. Connector body 78 extends from cap 76 into cavity 50 and includes a pocket 80 which provides clearance for silicone rubber molding 30. While plug 54 is shown as having a single pocket 80, it is within the scope of the present invention to provide a plurality of pockets 80, as shown in FIG. 9, equal to and in the same pattern as the plurality of conductor pins 22. The multiple pockets would provide additional sealing for the electrical connections as well as providing an increased distance for any electrical communication between pins because the electrical flow from one conductor pin 22 would be required to travel around the additional portion of body 78 located between the pins to reach an adjacent conductor pin 22. The exterior surface of body 78 is provided with a circumferentially extending lip seal 82 which provides a seal between the interior wall of fence 32 and connector body 78. Lip seal 82 is angled back towards cap 76, as shown in FIG. 4, such that during the assembly of plug 54 to terminal 14, air is forced past lip seal 82. After assembly of plug 54 to terminal 14, any effort to remove plug 54 will be resisted by the suction created within cavity 50 due to the sealing of lip seal 82. In addition, lip seal 82 insures that moisture and/or debris will not be allowed to enter cavity 50 and corrode the various electrical components including conductor pins 22 and receptacles 74. Fence 32 in conjunction with the recessing of receptacles 74 at the bottom of pocket 80 insures that electrical communication between conductor pins 22 and receptacles 74 will be terminated prior to pins 22 being able to be accessed by anyone removing plug 54 to service the assembly. This safety feature insures that plug 54 must be installed to operate compressor 10 eliminating any access to the conducting portion or wires 70 while compressor 10 is connected to the power source. This safety feature also eliminates the industry requirement of a terminal cover requiring a tool or a clip which requires a tool to remove the terminal cover.

FIG. 5 illustrates a terminal 14' which incorporates both a mis-wiring protection feature and a restriction for the access to the grounding connection. Terminal 14' is similar to terminal 14 except for the orientation of pins 22 in relationship to opening 52 and the incorporation of grounding lug 56'.

Pins 22 of terminal 14' are identical to pins 22 of terminal 14 with the exception of their orientation with respect to opening 52. Terminal 14 has opening 52 positioned vertically downward with a single pin 22 being positioned also in the vertically downward position within cavity 50. Terminal 14' includes a fence 32' which defines cavity 50 and opening 52 with opening 52 being positioned vertically downward also. In the embodiment shown in FIG. 5, a single pin 22 is positioned in the vertically upward position within cavity 50 which is opposite to the orientation shown in FIGS. 1 through 4. Thus, an individual attempting to insert plug 54 into terminal 14' would encounter a mis-alignment between pins 22 and receptacles 74 due to the circumferential alignment of plug 54 due to wires 70 extending through opening 52. This feature therefore requires a unique plug to be mated with terminal 14' to enable the engagement of pins 22 with receptacle 74. While FIGS. 2 and 5 illustrate two embodiments which require unique plugs for each embodiment, various other embodiments can be created by varying the relationship between pins 22 and opening 52.

Terminal 14' also includes grounding lug 56' which is disposed at a position which is generally perpendicular to conductor pins 22 rather than generally parallel to conductor pins 22 as shown for grounding lug 56. Fence 32' defines opening 52 which is adapted for receiving the incoming wires of plug 54 as is shown in FIG. 5. The portion of the wall which is cut out of fence 32' to form opening 52 is bent over generally perpendicular to conductor pins 22 at an approximate angle of 90° to form grounding lug 56'. Grounding lug 56' defines aperture 58 which is adapted to receive self-tapping screw 60 which holds grounding wire 62 onto terminal 14'. By having grounding lug 56' located adjacent to and facing opening 52, the removal of screw 60 and thus grounding wire 62 without the removal of the plug inserted into terminal 14' is prohibited. The plug inserted into terminal 14' will cover the head of screw 60 not allowing access to screw 60 thus insuring the proper grounding of the compressor assembly. This feature of restricting access to screw 60 could also be accomplished in the embodiment shown in FIGS. 1–4 by incorporating a shield (not shown) into plug 54 which would cover the head of screw 60 when plug 54 is inserted into terminal 14.

Referring now to FIG. 6, a terminal is shown having fence 32 replaced by fence 92. Fence 92 is similar to fence 32 in that it defines opening 52 but fence 92 is manufactured from a steel tube which is secured directly to shell 12 by resistance welding or other means known well in the art. The attachment of the steel tube of fence 92 directly to shell 12 eliminates the need for forming flange 46 and weld bead 48.

Referring now to FIG. 7, terminal 14 is shown comprising an integral terminal body and fence member 124 and a plurality of conductor pins 122. By combining terminal body 24 and fence 32 into integral body and fence member 124, the number of pieces to assemble by welding is reduced and the alignment between pins 122 and the interior surface of member 124 can be controlled better. In addition, a smaller sized plug 52 can be utilized due to the smaller diameter of the fence portion of member 124. The embodiment shown in FIG. 6 does not include opening 52 thus requiring plug 54 to be adapted for assembly with member 124 and connector pins 122 by the rerouting of wires 70 by methods known well in the art.

Conductor pins 122 are identical to conductor pins 22 shown in FIGS. 1–6 but their direction has been reversed in FIG. 7. Conductor pins 122 have reduced diameter section 36 located on the outside of shell 12 rather than on the interior as shown in FIGS. 1–6. The advantage to locating section 36 on the outside of shell 12 is that if section 36 should separate due to an overload condition, pins 122 would not be subject to being pushed out and the subsequent leaking of the seal of the terminal. Reduced diameter section 36 is also located exterior to fused glass insulator 26. This positioning of section 36 insures that insulator 26 will not be affected by the separating of section 36 thus insuring the integrity of cavity 16. It should be understood that conductor pins 122 and conductor pins 22 are interchangeable in all of the various embodiments of the present invention. The location of reduced diameter section 36 on the outside of shell 12 is permitted by electrical receptacles 74 and wires 70 being molded into plug 54 to maintain their separation should one or all of reduced diameter sections 36 separate.

Referring now to FIG. 8, a terminal is shown comprising an integral terminal body and fence member 134. Integral terminal body and fence member 134 is similar to member 124 with the exception that an annular flange 136 is formed to mate with a flattened section 138 of shell 12. Annular flange 136 contacts flattened section 138 along the entire circular area of flange 136. The mating of flange 136 to flattened section 138 of shell 12 facilitates the welding of member 134 to shell 12.

FIGS. 9 and 10 illustrate a plug 152 which is adapted to be used with a terminal when there is not a fence member present. Plug 152 includes a cylindrical body 154, a first rectangular member 156 and a second rectangular member 158. Cylindrical body 154 defines a pocket 160 which provides clearance for terminal body 24 such that a sealing face 162 located on body 154 is allowed to sealingly engage the outside surface of shell 12. In addition, pocket 160 is sized such that a slight interference fit with terminal body 24 is present in order to provide additional sealing between cylindrical body 154 and terminal body 24. Cylindrical body 154 further defines a second pocket 164 which provides clearances for rubber molding 30 when it is used with terminal 14. Second pocket 164 communicates with a plurality of smaller pockets 166 which are equal to and are arranged in the same pattern as the lo plurality of connector pins 22 or 122 on the associated terminal. Molded into cylindrical body 154 are the typical connectors 72 and receptacles 74. Again, receptacles 74 are equal in number to and are arranged in the same pattern as the plurality of connector pins 22 or 122 on the associated terminal.

Rectangular member 156 extends radially from body 154 and defines a recessed area 170. Recessed area 170 provides for the insertion of a screw driver or other similar tool between plug 152 and shell 12 to facilitate the removal of plug 152 from the terminal. Rectangular member 158 also extends radially from body 154 and provides for the access of wires 70 into plug 152 in an orderly manner.

Plug 152 is retained onto the terminal due to the slip fit of the connector pins 22 or 122 into receptacles 74 and the interference fit between body 154 and terminal body 24. The seating of surface 162 against the exterior of shell 12 and the interference fit between body 24 and terminal body 24 provide for a seal which insures that moisture and/or debris will not be allowed to enter pockets 160 or 164 and corrode the various electrical components of plug 152 and the terminal. The recessing of receptacles 74 within pocket 166 insures that electrical communication between the conductor pins 22 or 122 and receptacle 74 will be terminated prior to conductor pins 22 or 122 being able to be accessed by anyone servicing the assembly.

FIG. 11 illustrates a terminal body 200 and plug 202. Terminal body 200 includes an integral fence 204 which includes an annular groove 206 formed into the wall of fence 204. Terminal body 200 is sealing secured to shell 12 by resistance welding or other means known well in the art. Plug 202 defines an annular groove 208 which receives fence 204. An inwardly extending projection 210 is formed onto the inside wall of groove 208 to retain plug 202 onto terminal body 200. When properly seated, projection 210 will seat within groove 206 to retain plug 202 onto terminal body 200. If necessary for assembly, a plurality of narrow slits 212 can extend from the outer surface of plug 202 into annular groove 208 to allow projection 210 to slide over fence 204. An annular sealing bead 214 extends from plug 202 to interface with terminal body 200 to provide the required sealing for the electrical components.

Figure 12:
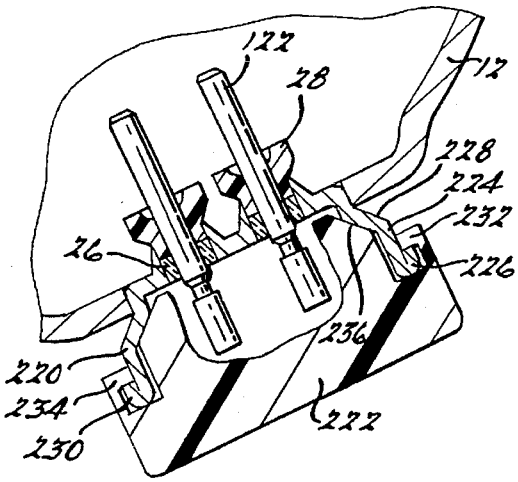
FIG. 12 is a cross-sectional side view of a terminal and plug in accordance with another embodiment of the present invention.

FIG. 12 illustrates a terminal body 220 and a plug 222. Terminal body 220 includes an integral fence 224 which has its outside end rolled outwardly over on itself to form a flange 226. Terminal body 220 is sealingly secured to shell 12 by resistance welding or other means known well in the art. Terminal body 220 includes conically shaped portion 228 which aids in the sealing between terminal body 220 and plug 222 as will be described later herein. Plug 222 defines an annular groove 230 which receives fence 224. An inwardly extending projection 232 is formed onto the inside wall of groove 230 to retain plug 222 onto terminal body 220. When properly seated, projection 232 will extend over flange 226 to retain plug 222 onto terminal body 220. If necessary for assembly, a plurality of narrow slits 234 can extend from the outside surface of plug 222 into annular groove 230 to allow projection 232 to slide over flange 226. Plug 222 includes a conical section 236 which is adapted to seat against the interior of conical shaped portion 228 of terminal body 220 to provide the required sealing for the electrical components.

Figure 13:
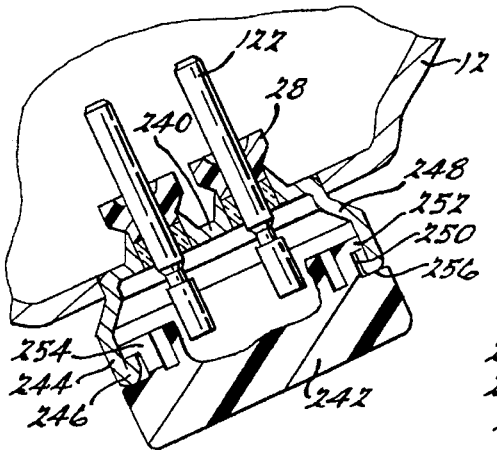
FIG. 13 is a cross-sectional side view of a terminal and plug in accordance with another embodiment of the present invention.

FIG. 13 illustrates a terminal body 240 and a plug 242. Terminal body 240 includes an integral fence 244 which has its outside end rolled inwardly onto itself to form a flange 246. Terminal body 240 is sealingly secured to shell 12 by resistance welding or other means known well in the art. Terminal body 240 includes a conically shaped portion 248 which aids in the sealing between terminal body 240 and plug 242 as will be described later herein. Plug 242 defines an annular groove 250 which receives fence 244. An outwardly extending projection 252 is formed onto the outside wall of groove 250 to retain plug 242 onto terminal body 240. When properly seated, projection 252 will extend inside of flange 246 to seal and retain plug 242 onto terminal body 240. If necessary for assembly, a plurality of narrow slits 254 can extend from the end surface of plug 242 into annular groove 250 to allow projection 252 to slide inside of flange 246. Plug 242 relies on the seating of groove 250 against the rolled end of fence 244 at point 256 and the engagement of plug 242 with conically shaped portion 248 to provide the required sealing for the electrical components.

Figure 14:
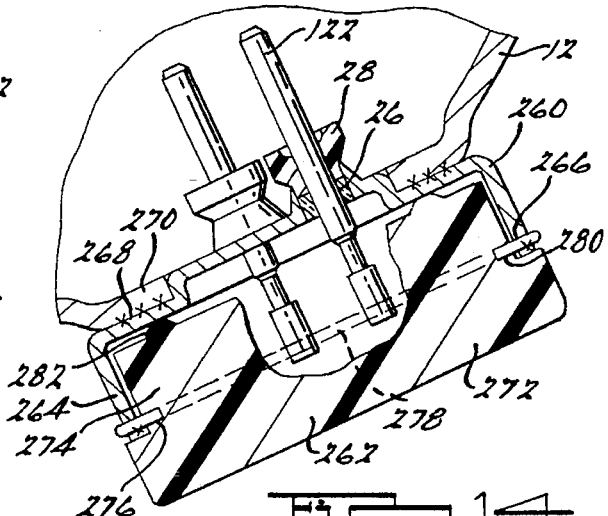
FIG. 14 is a cross-sectional side view of a terminal and plug in accordance with another embodiment of the present invention.

FIG. 14 illustrates a terminal body 260 and a plug 262. Terminal body 260 includes an integral fence 264 and a pair of retaining holes 266 which extend through fence 264. Terminal body 260 further includes a flat annular section 268 which mates with a flattened section 270 located on shell 12 to facilitate the attachment of terminal body 260 to shell 12. Terminal body 260 is sealingly secured to shell 12 by resistance welding between flattened section 270 and section 268 or by other means known well in the art. Plug 262 includes an end cap 272 and a connector body 274. Cap 272 seats against the outside edge of fence 264 when plug 262 is properly installed on terminal body 260. The seating of cap 272 against fence 264 aids in the sealing of the electrical components. Connector body 274 extends from cap 272 and includes a pair of retaining apertures 276 which extend into body 274. Apertures 276 are positioned on body 274 such that when plug 262 is properly installed onto terminal body 260, apertures 276 are in registry with the pair of retaining holes 266 extending through fence 264. A semi-circular spring retainer 278 having a pair of retaining tabs 280 retains plug 262 onto terminal body 260 by having one retaining tab 280 extend through a respective retaining hole 266 and retaining aperture 276. An annular sealing bead 262 extends from connector body 274 to interface with terminal body 260 to provide additional sealing for the electrical components.

Figure 15:
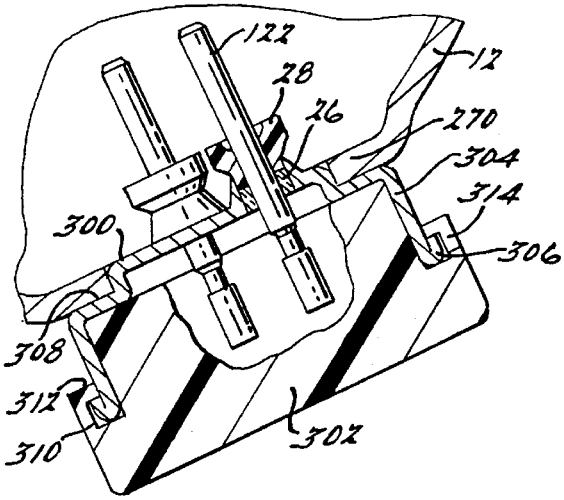
FIG. 15 is a cross-sectional side view of a terminal and plug in accordance with another embodiment of the present invention.

FIG. 15 illustrates a terminal body 300 and a plug 302. Terminal body 300 includes an integral fence 304 which has its outside end rolled outwardly over on itself to form a flange 306. Terminal body 300 further includes a flat annular section 308 which mates with flattened section 270 located on shell 12 to facilitate the attachment of terminal body 300 to shell 12. Terminal body 300 is sealingly secured to shell 12 by resistance welding between flattened section 270 and section 308 or by other means known well in the art. Plug 302 defines an annular groove 310 which receives fence 304. An inwardly extending projection 312 is formed onto the inside wall of groove 310 to retain plug 302 onto terminal body 300. When properly seated, projection 312 will extend over flange 306 to seal and retain plug 302 onto terminal body 300. If necessary for assembly, a plurality of narrow slits 314 can extend from the outside surface of plug 302 into annular groove 310 to allow projection 312 to slide over flange 306. The sealing for the electrical components is provided by the seating of lip 306 into annular groove 310 and the seating of plug 302 against flat annular section 270 of terminal body 300.

Figure 16:
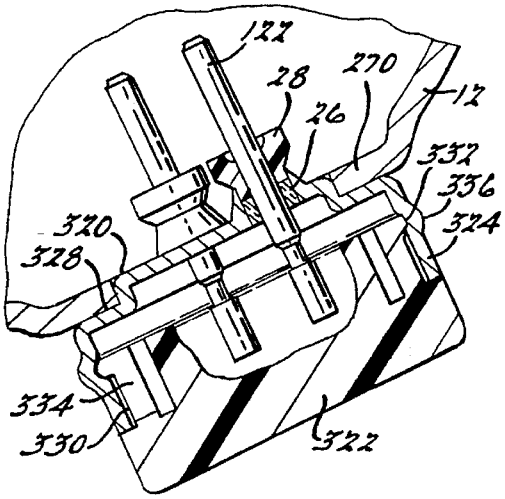
FIG. 16 is a cross-sectional side view of a terminal and plug in accordance with another embodiment of the present invention.

FIG. 16 illustrates a terminal body 320 and a plug 322. Terminal body 320 includes an integral fence 324 which has its an annular groove 326 formed into the wall of fence 324. Terminal body 320 further includes a flat annular section 328 which mates with flattened section 270 located on shell 12 to facilitate the attachment of terminal body 320 to shell 12. Terminal body 320 is sealingly secured to shell 12 by resistance welding between flattened section 270 and section 328 or by other means known well in the art. Plug 322 defines an annular groove 330 which receives fence 324. An outwardly extending projection 332 is formed onto the outside wall of groove 330 to retain plug 322 onto terminal body 320. When properly seated, projection 332 will extend into annular groove 326 to seal and retain plug 322 onto terminal body 320. If necessary for assembly, a plurality of narrow slits 334 can extend from the inside surface of plug 322 into annular groove 330 to allow projection 332 to slide into fence 324. The sealing for the electrical components is provided by the seating of projection 332 into annular groove 306 and the seating of plug 322 against the end of fence 324 of terminal body 320.

While the above detailed description describes the preferred embodiment of the present invention, it should be understood that the present invention is susceptible to modification, variation and alteration without deviating from the scope and fair meaning of the subjoined claims.

What is claimed is:

1. A terminal assembly for a compressor having a shell, said terminal assembly comprising:

a terminal body secured to said shell;

at leat one conductor pin extending through said terminal body;

an insulating member disposed between said terminal body and said conductor pin;

a fence disposed around said terminal body, said fence being secured to said shell; and an electrical plug at least partially disposed within said fence and having at least one electrical receptacle, said electrical receptacle being in electrical communication with said conductor pin, said electrical plug inlucing a lip seal for sealingly engaging said fence.

2. The terminal assembly according to claim 1 wherein said conductor pin includes a fuse-like link.

3. The terminal assembly according to claim 2 wherein said fuse-like link comprises a reduced diameter section of said conductor pin.

4. The terminal assembly according to claim 3 wherein said reduced diameter section is located within said shell.

5. The terminal assembly according to claim 3 wherein said reduced diameter section is located outside of said shell.

6. The terminal assembly according to claim 1 wherein said fence is integral with said terminal body.

7. The terminal assembly according to claim 1 wherein said fence including a grounding lug.

8. The terminal assembly according to claim 7 wherein the plane of said grounding lug extends generally parallel with the axis of said conductor pin.

9. The terminal assembly according to claim 7 wherein the plane of said grounding lug extends generally perpendicular to the axis of said conductor pin.

10. The terminal assembly according to claim 7 wherein said plug restricts access to said grounding lug.

11. The terminal assembly according to claim 1 wherein said electrical plug interlocks with said fence in order to retain said electrical communication between said electrical receptacle and said conductor pin.

12. The terminal assembly according to claim 1 wherein said fence is located on said shell by engagement with said terminal body.

13. The terminal assembly according to claim 1 wherein said electrical receptacle is located within said electrical plug such that upon disengagement of said electrical plug from said fence, said electrical receptacle disengages said conductor pin prior to said electrical plug disengaging said fence.

14. The terminal assembly according to claim 1 wherein said electrical plug is manually removable from said fence without the use of a tool.

15. A terminal assembly for a compressor having a shell, said terminal assembly comprising:

a terminal body secured to said shell;

a plurality of conductor pins extending through said terminal body, said plurality of conductor pins being arranged in a specific pattern;

a fence disposed around said terminal body and being secured to said shell, said fence defining an opening disposed in a specified location with respect to said specified pattern of said plurality of conductor pins; and an electrical plug at least partially disposed within said fence and having a plurality of electrical receptacles corresponding to said plurality of conductor pins and arranged in said specified pattern, said electrical plug including a radially extending jacket, said jacket being disposed in said specified location with respect to said specified pattern of said electrical receptacles such that when said jacket is aligned with said opening in said fence, said electrical receptacles are in registry with said conductor pins, said electrical plug including a lip seal for sealingly engaging said fence.

16. The terminal assembly according to claim 15 wherein said conductor pin includes a fuse-like link.

17. The terminal assembly according to claim 16 wherein said fuse-like link comprises a reduced diameter section of said conductor pin.

18. The terminal assembly according to claim 17 wherein said reduced diameter section is located within said shell.

19. The terminal assembly according to claim 17 wherein said reduced diameter section is located outside of said shell.

20. The terminal assembly according to claim 15 wherein said fence includes a grounding lug.

21. The terminal assembly according to claim 20 wherein the plane of said grounding lug extends generally parallel with the axis of said conductor pins.

22. The terminal assembly according to claim 20 wherein the plane of said grounding lug extends generally perpendicular to the axis of said conductor pins.

23. The terminal assembly according to claim 20 wherein said plug restricts access to said grounding lug.

24. The terminal assembly according to claim 15 wherein said electrical plug interlocks with said fence in order to retain said electrical communication between said electrical receptacle and said conductor pins.

25. The terminal assembly according to claim 15 wherein said fence is located on said shell by engagement with said terminal body.

26. The terminal assembly according to claim 15 wherein said electrical receptacles are located within said electrical plug such that upon disengagement of said electrical plug from said fence, said electrical receptacles disengage said conductor pins prior to said electrical plug disengaging said fence.

27. The terminal assembly according to claim 15 wherein said fence is integral with said terminal body.

28. The terminal assembly according to claim 15 wherein said electrical plug is manually removable from said fence without the use of a tool.

29. The terminal assembly according to claim 15 wherein said electrical plug defines a plurality of pockets corresponding to said plurality of conductor pins and arranged in said specified pattern.

30. A method of manufacturing a compressor having a shell, a terminal body and a separate fence comprising the steps of:

forming an aperture in said shell;

locating said terminal body within said aperture in said shell such that a portion of said terminal body extends outward of an exterior surface of said shell;

positioning said fence on said exterior surface of said shell such that said fence is located by engagement with said terminal body; and simultaneously welding said terminal body and said fence to said shell.

31. The method of manufacturing a compressor according to claim 30 wherein said welding step comprises resistance welding said terminal body and said fence to said shell.

32. A plug for a compressor, said plug comprising:

a body;

at least one electrical receptacle disposed within said body, said electrical receptacle providing for electrical communication to said compressor, said body being adapted to cooperate with said compressor to provide the only enclosure for said electrical receptacle; and an annular sealing bead extending from said body for sealingly engaging a component of said compressor.

33. A terminal assembly for a compressor having a shell, said terminal assembly comprising;

a terminal body secured to said shell;

at least one conductor pin extending through said terminal body;

an insulating member disposed between said terminal body and said conductor pin;

a fence disposed around said terminal body, said fence being secured to said shell; and an electrical plug at least partially disposed within said fence and having at least one electrical receptacle, said electrical receptacle being in electrical communication with said conductor pin, said electrical plug including an annular sealing bead for sealingly engaging said fence.

34. A terminal assembly for a compressor having a shell, said terminal assembly comprising;

a terminal body secured to said shell;

at least one conductor pin extending through said terminal body;

an insulating member disposed between said terminal body and said conductor pin;

a fence including a grounding lug disposed around said terminal body, said fence being secured to said shell; and an electrical plug at least partially disposed within said fence and having at least one electrical receptacle, said electrical receptacle being in electrical communication with said conductor pin, said plug restricting access to said grounding lug.

35. A terminal assembly for a compressor having a shell, said terminal assembly comprising:

a terminal body secured to said shell;

a plurality of conductor pins extending through said terminal body, said plurality of conductor pins being arranged in a specific pattern;

a fence disposed around said terminal body and being secured to said shell, said fence defining an opening disposed in a specified location with respect to said specified pattern of said plurality of conductor pins; and an electrical plug at least partially disposed within said fence and having a plurality of electrical receptacles corresponding to said plurality of conductor pins and arranged in said specified pattern, said electrical plug including a radially extending jacket, said jacket being disposed in said specified location with respect to said specified pattern of said electrical receptacles such that when said jacket is aligned with said opening in said fence, said electrical receptacles are in registry with said conductor pins, said electrical plug including an annular sealing bead for sealingly engaging said fence.

36. A terminal assembly for a compressor having a shell, said terminal assembly comprising:

a terminal body secured to said shell;

a plurality of conductor pins extending through said terminal body, said plurality of conductor pins being arranged in a specific pattern;

a fence including a grounding lug disposed around said terminal body and being secured to said shell, said fence defining an opening disposed in a specified location with respect to said specified pattern of said plurality of conductor pins; and an electrical plug at least partially disposed within said fence and having a plurality of electrical receptacles corresponding to said plurality of conductor pins and arranged in said specified pattern, said electrical plug including a radially extending jacket, said jacket being disposed in said specified location with respect to said specified pattern of said electrical receptacles such that when said jacket is aligned with said opening in said fence, said electrical receptacles are in registry with said conductor pins, said plug restricting access to said grounding lug.

* * * * *

UNITED STATES PATENT AND TRADEMARK OFFICE

CERTIFICATE OF CORRECTION

PATENT NO. : 5,584,716

DATED : December 17, 1996

INVENTOR(S) : Ernest Bergman

It is certified that error appears in the above-indentified patent and that said Letters Patent is hereby corrected as shown below:

Column 1, line 24, "devises" should be -- devices --.

Column 4, line 45, "extent" should be -- extend --.

Column 7, line 64, delete "lo".

Column 8, line 27, "sealing" should be -- sealingly --.

Column 9, line 35, "262" should be -- 282 --.

Column 9, line 62, delete "its".

Column 10, line 22, "leat" should be -- least --.

Column 10, line 32, "inlucing" should be -- including --.

Column 10, line 46, "including" should be -- includes --.

Signed and Sealed this

Eighth Day of July, 1997

Bruce Lehman

*Attest:*

BRUCE LEHMAN

*Attesting Officer*

*Commissioner of Patents and Trademarks*